US005192088A

United States Patent [19]

Yu

[11] Patent Number: 5,192,088

[45] Date of Patent: Mar. 9, 1993

[54] ROLLER SKATE WITH DEVICE FOR ASSISTING THE TURNING AND BRAKING ACTION THEREOF

[76] Inventor: Chung-Hsiung Yu, 2nd Fl., No. 94, Chung-Yuan St., Taipei City, Taiwan

[21] Appl. No.: 844,726

[22] Filed: Mar. 2, 1992

[51] Int. Cl.[5] ..... A63C 17/06

[52] U.S. Cl. ..... 280/11.22; 280/11.19; 280/11.23; 280/11.27

[58] Field of Search ..... 280/11.22, 11.23, 11.19, 280/11.28, 11.27

[56] References Cited

U.S. PATENT DOCUMENTS 2,430,037 11/1947 Vincent ..... 280/11.27
3,862,763 1/1975 Ware ..... 280/11.28

FOREIGN PATENT DOCUMENTS 106651 1/1875 France ..... 280/11.15
3708 of 1876 United Kingdom ..... 280/11.19

*Primary Examiner*—Eric D. Culbreth
*Attorney, Agent, or Firm*—Ladas & Parry

[57] ABSTRACT

A roller skate having rollers aligned along a longitudinal axis thereof is equipped with a device which includes a mounting seat attached to the skate body adjacent to the front or rear end thereof. A pair of mounting shafts are mounted on the mounting seat and extend in such a manner that they form an angle therebetween and that they are symmetric with respect to the longitudinal axis. A pair of auxiliary rollers are mounted respectively to the mounting shafts so that they lie in two imaginary planes which are perpendicular to the mounting shafts, respectively, and which form a V-shape symmetric with respect to the longitudinal axis. The device assists the turning and braking action of the roller skate.

10 Claims, 6 Drawing Sheets

ROLLER SKATE WITH DEVICE FOR ASSISTING THE TURNING AND BRAKING ACTION THEREOF

BACKGROUND OF THE INVENTION

This invention relates to a roller skate, and particularly to a roller skate which has main rollers aligned along a longitudinal axis thereof and which is equipped with a device including auxiliary rollers to assist the turning and braking action thereof.

BRIEF DESCRIPTION OF THE RELATED PRIOR ART

Roller skates having linearly arranged operating rollers are known in the art. FIG. 1 shows one of such roller skates, which comprises a skate body 11 and three flat rollers 12 aligned along a longitudinal axis of the skate body. A brake device 13 is provided at the rear end of the skate body. Such a roller skate produces a reduced friction during its operation so that it can operate quickly. However, it is liable to cause a beginner to lose balance and fall down.

SUMMARY OF THE PRESENT INVENTION

An object of the present invention is to provide a roller skate of the type having operating rollers aligned along a longitudinal axis thereof with a device for assisting the turning and braking operation thereof. The device provides a controlling action when the roller skate is turned, thereby alleviating the risk that the operator will lose balance and fall down.

The present invention provides a device for braking and assisting the turning action of a roller skate of the type having rollers aligned along a longitudinal axis of the roller skate. The device comprises a mounting seat to be attached to the roller skate adjacent to the front end or the rear end of the skate; a pair of mounting shafts mounted on the mounting seat and extending in a fashion that they form an angle therebetween and that they are symmetric with respect to the axis of the roller skate; and a pair of auxiliary rollers mounted respectively to the mounting shafts so that they lie in two imaginary planes which are perpendicular to the mounting shafts, respectively, and which form an angle therebetween. The mounting seat may include a plate which has two mounting arms extending upward from two opposite sides of the plate to be connected to the bottom side of the roller skate along the axis thereof.

In another aspect of this invention, the mounting plate has a main screw member provided at a point on the axis of the roller skate and two adjustment screw members on two sides of the axis, each of the mounting shafts having a flat end, said flat end having a main screw hole through which said flat end is screwed to said plate via said main screw member, said flat end of each mounting shaft further having an elongated adjustment slot inward of the main screw hole to receive respective adjustment screw members, whereby the angle between the auxiliary rollers can be adjusted.

The present exemplary preferred embodiment will be described in detail with reference to the accompanying drawings, in which:

DETAILED DESCRIPTION OF THE PREFERRED EMBODIMENT

Figure 1:
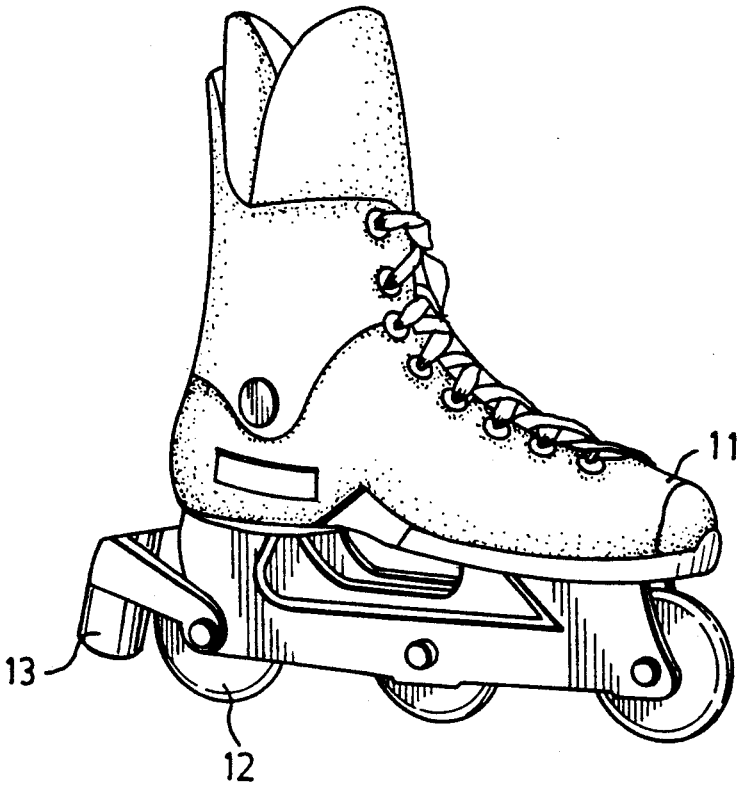
FIG. 1 PRIOR ART
FIG. 1 shows a conventional roller skate.
Figure 2:
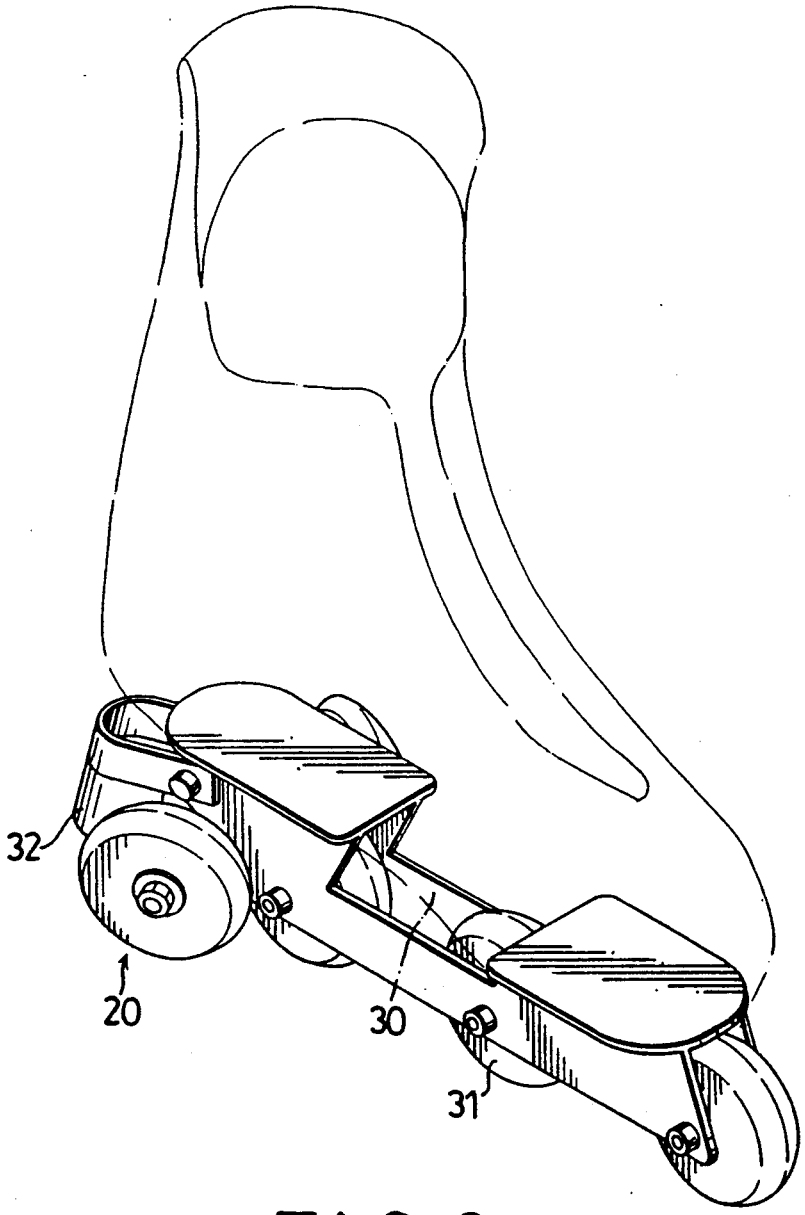
FIG. 2 is a perspective view of a roller skate incorporating the device of this invention.
Figure 3:
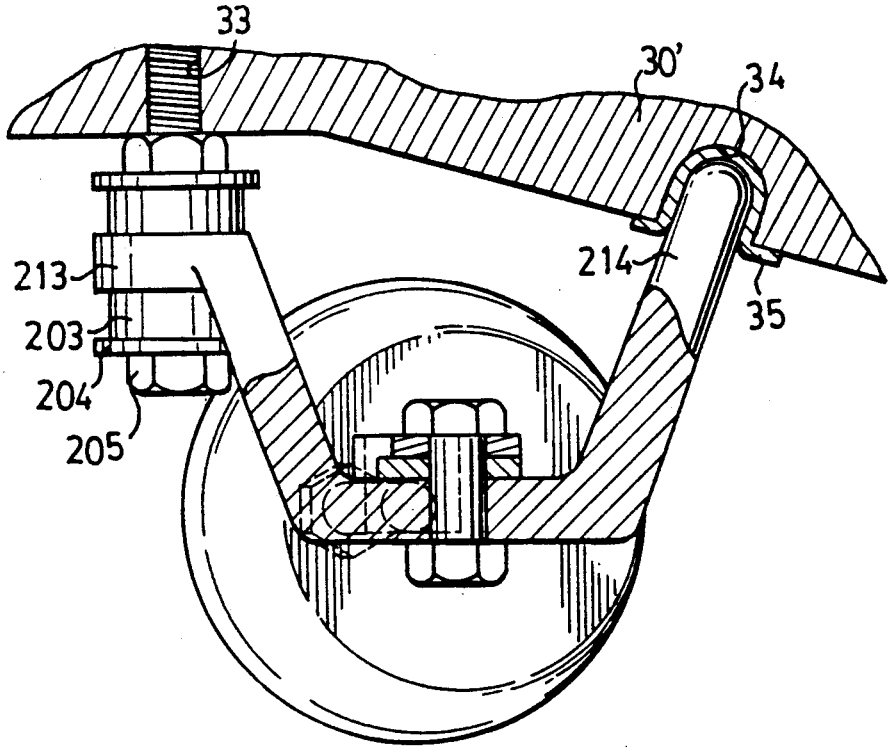
FIG. 3 is a sectional view showing an embodiment of this invention.

The device for assisting the turning and braking action of a roller skate according to this invention can be installed in a roller skate at either the rear side or the front side of the skate. FIGS. 2 and 3 illustrate an embodiment in which the device of this invention is installed in the rear side of a roller skate. This embodiment comprises a roller skate 30 equipped with three rollers 31 which are aligned along an axis extending between the front end and the rear end of the roller skate 30. The rear side of the skate 30 is provided with a brake device 32. The bottom side of the frame 30' of the roller skate is provided with a screw hole 33 and an engaging hole 34 in which a shock-absorbing rubber pad 35 is provided.

Figure 4:
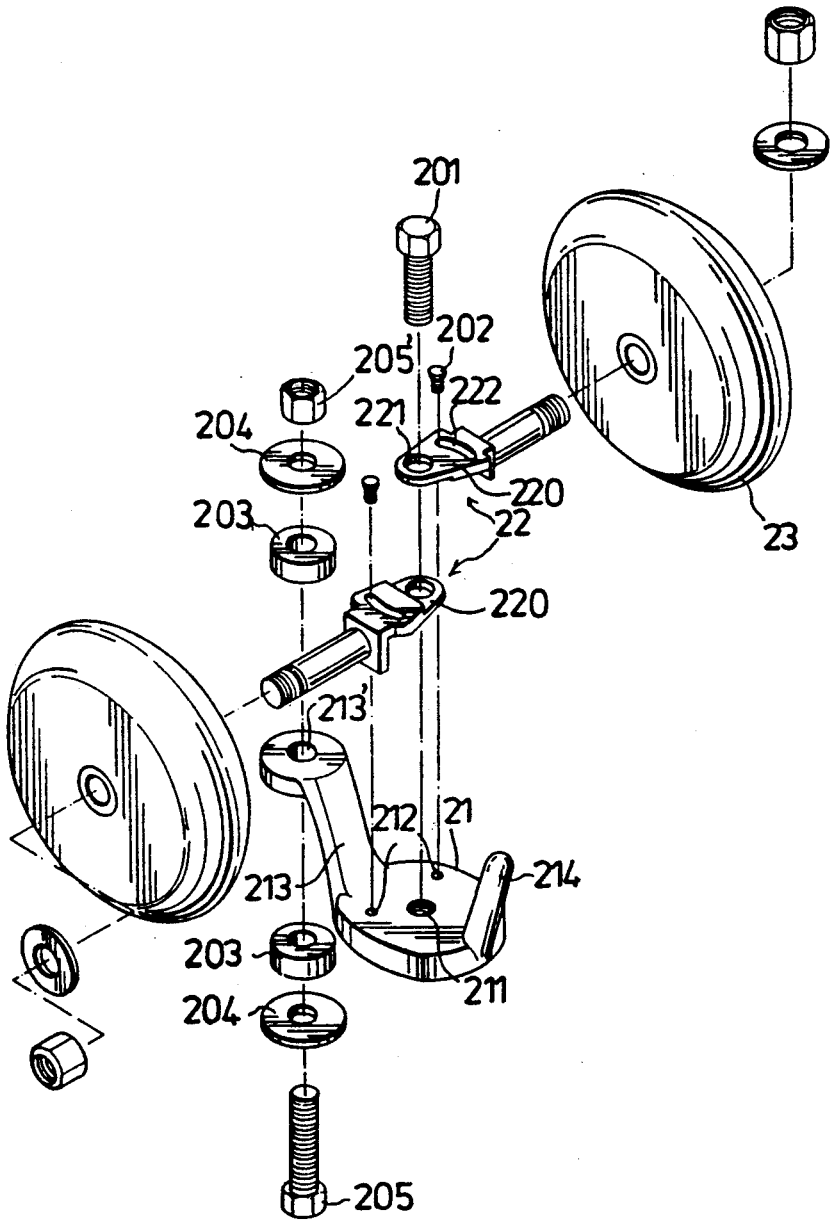
FIG. 4 is an exploded view of the embodiment of FIG. 3.
Figure 5:
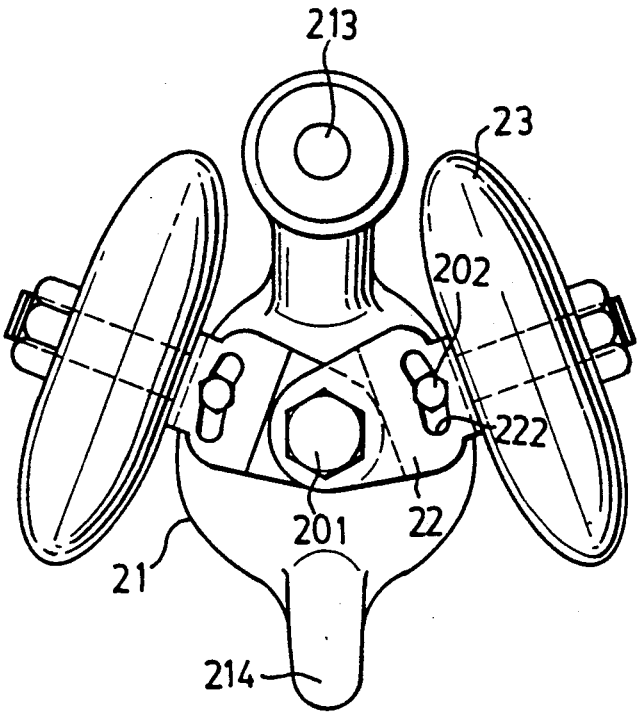
FIG. 5 is a plan view of the embodiment of FIG. 3.

Referring to FIGS. 4 and 5, a device 20 for assisting the turning and braking action comprises a mounting seat including a plate 21. The plate 21 has a central screw hole 211 and two adjustment slots 212. The plate 21 has an upward extending mounting arm 213 with a mounting hole 213'. The mounting arm 213 is screwed to the frame 30' of the roller skate via a bolt 205 and a nut 205'. Shock-absorbing pads 203 and washers 204 are sleeved around the bolt 205. The mounting plate 21 further has an upward mounting arm 214 posterior to the mounting arm 213. This mounting arm 214 engages in the engaging hole 34 of the frame 30' of the roller skate. The mounting arm 214 extends into the engaging hole 34. The configuration of plate 21 and mounting arms 213 and 214 is such as to cause auxiliary rollers 23 to be raised from the ground when the roller skate is not braked.

Two mounting shafts 22 are mounted to said mounting plate 21 in such a manner that they form an angle therebetween and are symmetric with respect to the axis of the roller skate which extends between the rear end and the front end of thereof. Each of the mounting shafts 22 has a flat end 220 which is provided with a screw hole 221 and an elongated adjustment slot 222. The flat ends 220 are overlapped and screwed to the mounting plate 21 by means of a bolt 201 which passes through the hole 221 and the hole 211. Two adjustment screws 202 respectively pass through the adjustment holes 212 of the mounting plates and the elongated slots 222 of the flat ends 220. The angle between the mounting shafts 22 can be adjusted by loosening and shifting the screws 202.

Two auxiliary rollers 23 are mounted to the ends of the mounting shafts 22 so that they lie in two imaginary planes which are perpendicular to respective mounting shafts 22 and which form a V shape symmetric with respect to the axis of the roller skate. The auxiliary rollers 23 diverge rearward and are higher than the main rollers 31 of the roller skate.

Figure 6:
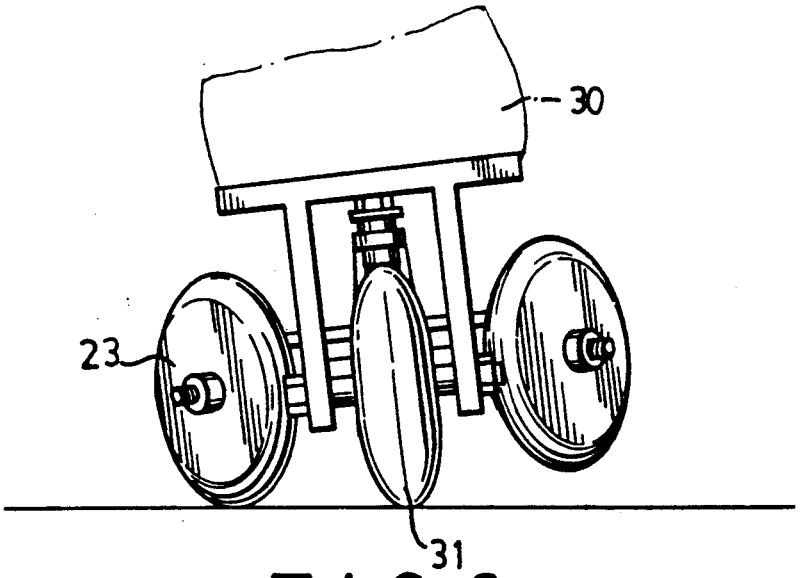
FIG. 6 is an elevation view of the embodiment of FIG. 3.

FIG. 6 shows a situation in which the roller skate is about to turn right. The roller skate is tilted to the right so that the right side auxiliary roller 23 contacts the ground simultaneously with the main rollers 31. In this situation, the right side auxiliary roller 23 attributes a controlled and stabilized turning action to the roller skate. Similarly, if the roller skate is to be turned left, it must be tilted to the left so as to make the left side auxiliary roller 23 contact the ground.

When the roller skate is braked, the roller skate is slightly tilted rearward so that the two auxiliary rollers 23 contact the ground. Since the imaginary planes of the auxiliary rollers 23 form an angle with the longitudinal axis of the roller skate, the auxiliary rollers 23 provide a movement-impeding action in addition to the action of the brake 32.

Figure 7:
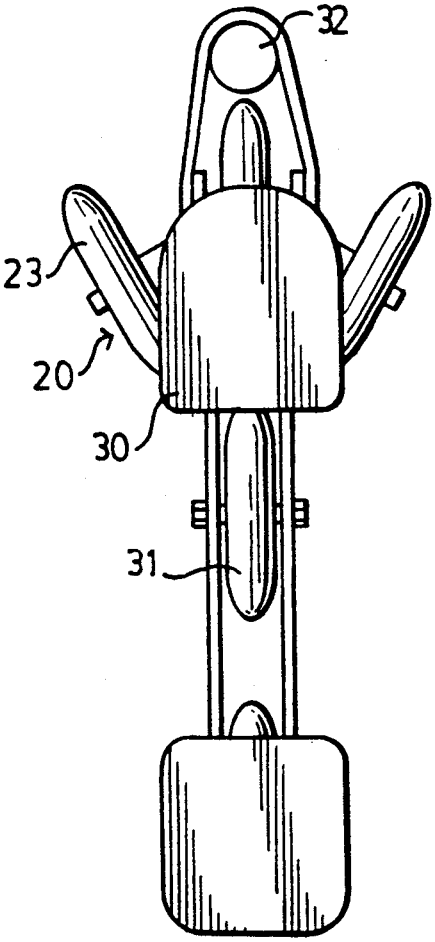
FIG. 7 is a plan view of another embodiment.

FIG. 7 shows another embodiment of the present invention, in which the auxiliary rollers 23 are attached to the skate body adjacent to a front end of the roller skate. In this case, the imaginary planes of the auxiliary rollers 23 diverge forward and the mounting arm 214 is anterior to the mounting arm 213.

Figure 8:
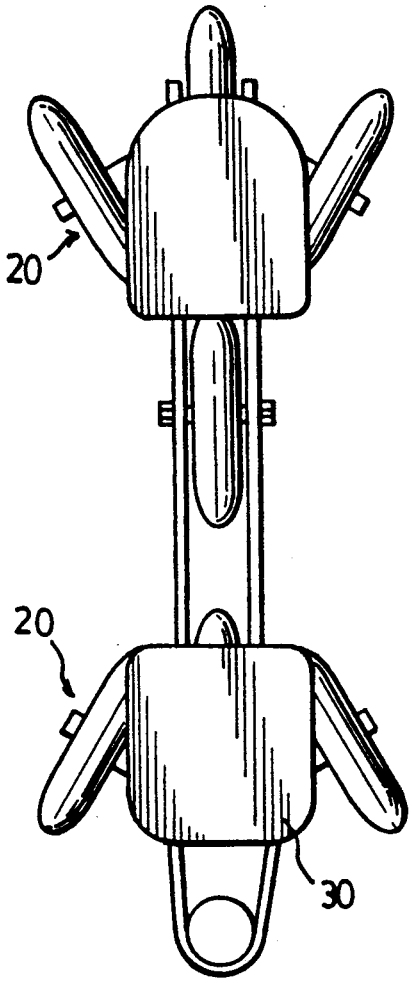
FIG. 8 is a plan view of still another embodiment.

FIG. 8 shows still another embodiment in which two pairs of auxiliary rollers 23 are attached respectively to the rear and front parts of the roller skate. When the roller skate is turned left or right, the two right or left auxiliary rollers 23 will simultaneously contact the ground. A more stabilizing effect can be obtained during the turning operation of the roller skate when the roller skate of this embodiment is used.

With the invention thus explained, it is apparent that various modifications and variations can be made without departing from the scope of this invention. It is therefore intended that the invention be limited only as indicated in the appended claims.

I claim:

1. A device for assisting the turning and braking action of a roller skate which has rollers aligned along an axis extending between a first end and a rear end of said roller skate, comprising:

at least one mounting seat to be attached to the roller skate adjacent to at least one of said ends, said mounting seat including a plate which has a first end, a second end, two mounting arms extending upward from said first end and said second end of said plate, said mounting arms adapted to be connected to said roller skate along said axis of aid roller skate, a main screw member provided at a point on said axis of said roller skate and two adjustment screw members on two sides of said axis;

a pair of mounting shafts mounted on said mounting seat and extending in a fashion that they form an angle therebetween and that they are symmetric with respect to said axis of said roller skate, each of said mounting shafts having a flat end, said flat end having a main screw hole through which said flat end is screwed to said plate via said main screw member; and a pair of auxuliary rollers mounted respectively to said mounting shafts so that they lie in two imaginary planes which are perpendicular to said mounting shafts, respectively, and which form an angle therebetween, said flat end of each of said mounting shafts further having an elongated adjustment slot outward of said main screw hole to receive a respective one of said adjustment screw members, whereby the angle between said auxiliary rollers can be adjusted so that said auxiliary rollers are symmetric with respect to said axis of said roller skate.

2. A device as claimed in claim 1, wherein said mounting seat is attached to said skate body adjacent to said rear end, said first end of said plate being posterior to said second end.

3. A device as claimed in claim 1, wherein said mounting seat is attached to said skate body adjacent to said front end, said first end of said plate being anterior to said second end.

4. A device as claimed in claim 1, comprising two said mounting seats, wherein one of said mounting seats is attached to said skate body adjacent to said rear end, said first end of said plate of said one of said mounting seats being posterior to said second end thereof, the other one of said mounting seats being adjacent to said front end, said first end of said plate of said other one of said mounting seats being anterior to said second end thereof.

5. A device as claimed in claim 1, further comprising shock-absorbing pads provided at the connections between said mounting arms and the parts of said roller skate to which said mounting arms are attached.

6. A roller skate comprising:

a skate body having roller aligned along an axis extending between a front end and a rear end of said skate body;

at least one mounting seat attached to a bottom side of said skate body adjacent to at least one of said ends, said mounting seat including a plate which has a first end, a second end, two mounting arms extending upward from said first end and said second end of said plate, said mounting arms connected to said roller skate along said axis of said roller skate, a main screw member provided at a point of said axis of said roller skate and two adjacent screw members on two sides of said axis;

a pair of mounting shafts mounted on each of said at least one mounting seats and extending in a fashion that they form an angle therebetween and that they are symmetric with respect to said axis of said roller skate, each of said mounting shafts having a flat end, said flat end having a main screw hole through which said flat end is screwed to said plate via said main screw member; and a pair of auxiliary rollers mounted respectively to each of said at least one pair of mounting shafts so that they lie in two imaginary planes which are perpendicular to said mounting shafts, respectively, and which form an angle therebetween, said flat end of each of said mounting shafts further having an elongated adjustment slot outward of said main screw hole to receive a respective one of said adjustment screw members, whereby the angle between said auxiliary rollers can be adjusted, said auxiliary rollers being symmetric with respect to said axis of aid roller skate and diverging toward said adjacent end of said skate to which said at least one mounting seat is attached, said auxiliary rollers being mounted so as to be raised from the ground when said roller skate is not braked.

7. A roller skate as claimed in claim 6, wherein said mounting seat is attached to said skate body adjacent to said rear end, said first end of said plate being posterior to said second end.

8. A roller skate as claimed in claim 6, wherein said mounting seat is attached to said skate body adjacent to said front end, said first end of said plate being anterior to said second end.

9. A roller skate as claimed in claim 6, comprising two said mounting seats, wherein one of said mounting seats is attached to said skate body adjacent to said rear end, said first end of said plate of said one of said mounting seats being posterior to said second end thereof, the other one of said mounting seats being adjacent to said front end, said first end of said plate of said other one of said mounting seats being anterior to said second end thereof.

10. A roller skate as claimed in claim 6, comprising shock-absorbing pads provided at the connections between said mounting arms and the parts of said skate body to which said mounting arms are attached.

* * * * *